United States Patent [19]

Schaming

[11] 4,391,219

[45] Jul. 5, 1983

[54] IONIC STRIP COATER

[76] Inventor: Edward J. Schaming, P.O. Box 1070, Butler, Pa. 16001

[21] Appl. No.: 283,643

[22] Filed: Jul. 15, 1981

[51] Int. Cl.[3] ..... B05B 5/04; B05B 7/08

[52] U.S. Cl. ..... 118/630; 118/316; 118/325; 118/326; 239/299; 239/705

[58] Field of Search ..... 118/630, 315, 629, 631–633, 118/316, 325, 326; 427/13, 32; 239/193, 194, 295, 296, 420, 705, 299

[56] References Cited

U.S. PATENT DOCUMENTS 2,666,716 1/1954 Kadell ..... 118/630 X
3,608,822 9/1971 Berthoud ..... 118/629 X

FOREIGN PATENT DOCUMENTS 1430231 3/1976 United Kingdom ..... 118/315

*Primary Examiner*—Evan K. Lawrence
*Attorney, Agent, or Firm*—D. Paul Weaver

[57] ABSTRACT

A high voltage charge at very low amperage is impressed on a bath of oil or other lubricant in a dielectric header through a submerged electrode. A grounded high speed moving metal strip attracts streams of the charged bath across its width through apertures or slots provided in the header. Pressurized air jets directed at these streams disperse the streams into a multitude of finer crossing streams which coat the strip completely and evenly. A recovery system for the oil or other lubricant is provided.

5 Claims, 6 Drawing Figures

FIG. 1
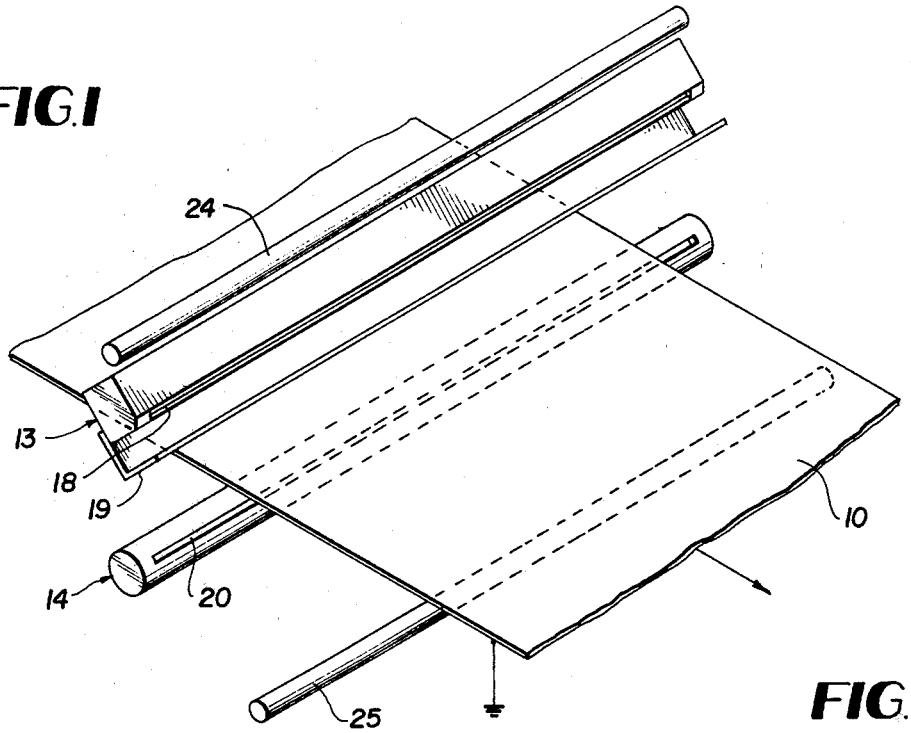
FIG. 2
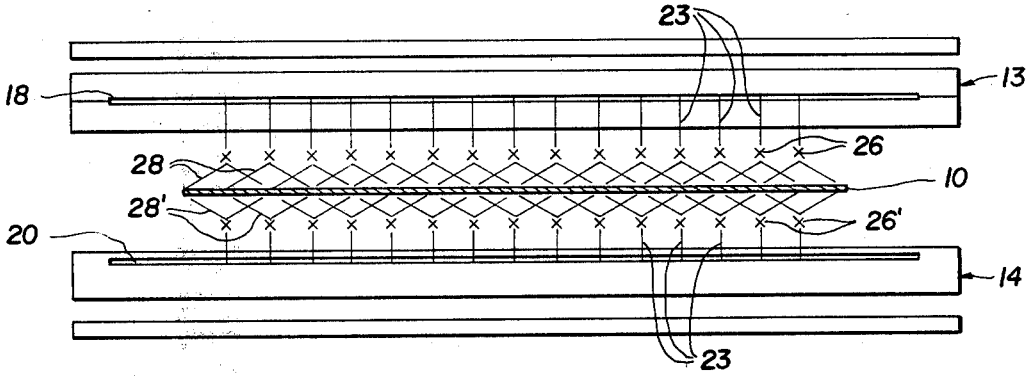
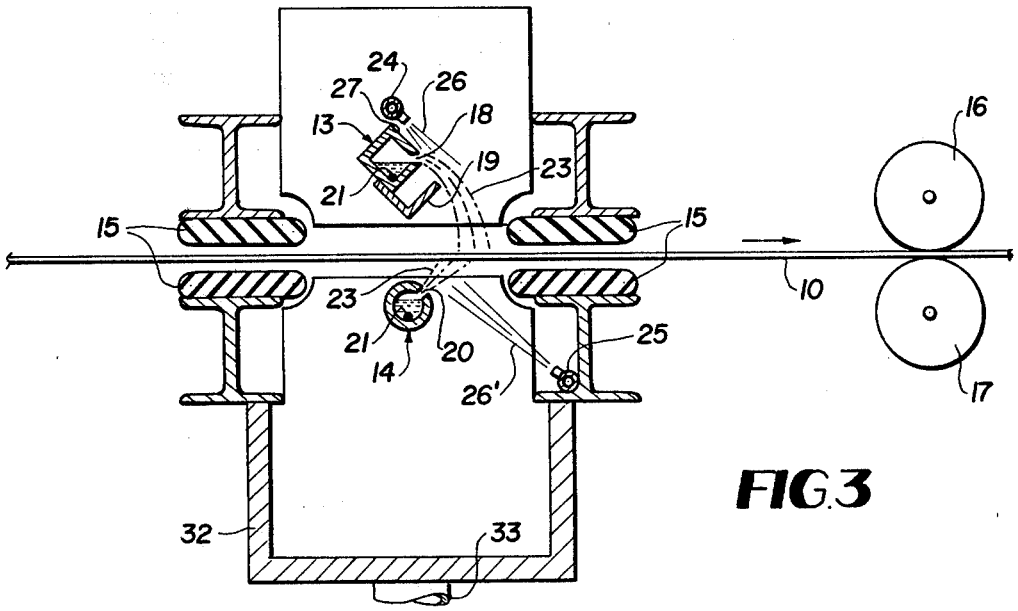
FIG. 3

FIG. 5
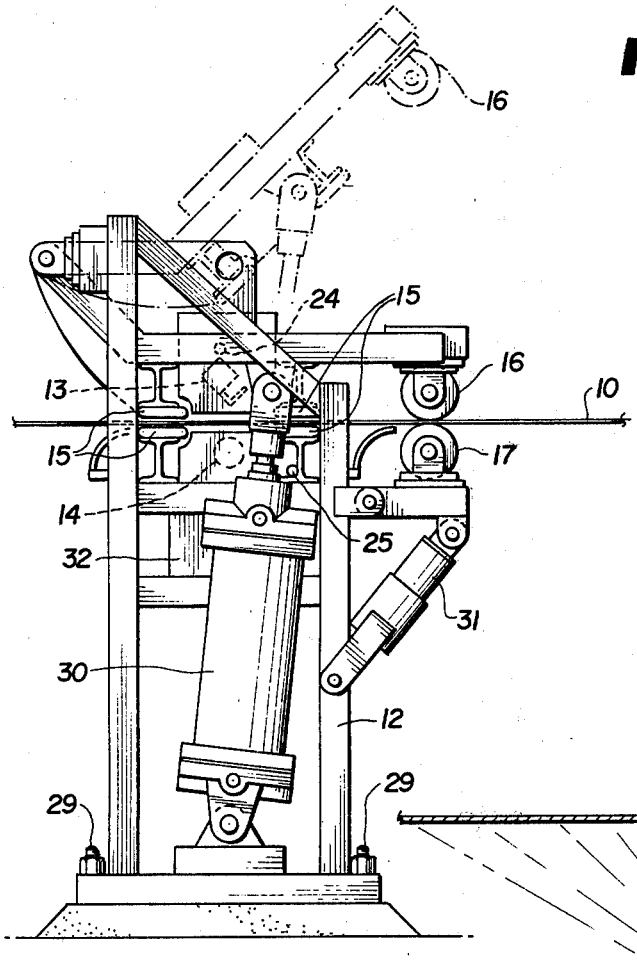
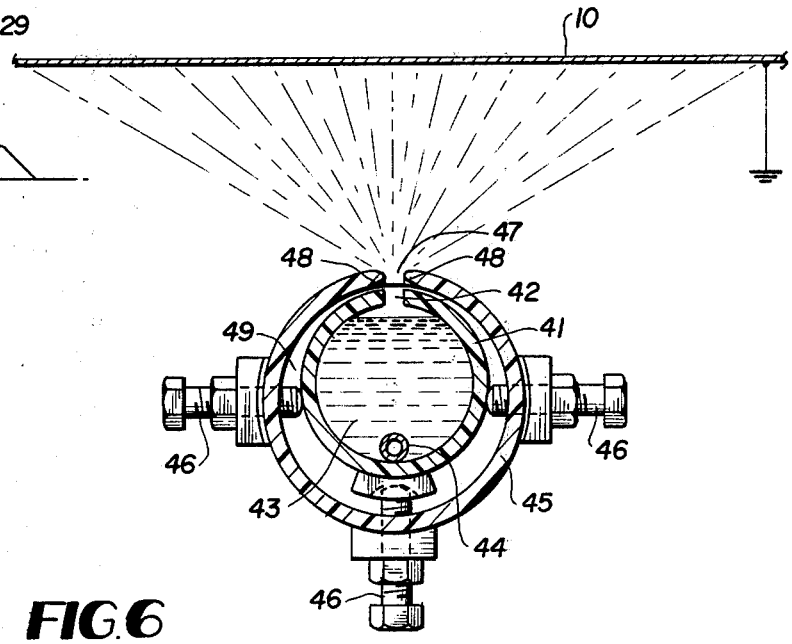
FIG. 6

IONIC STRIP COATER

BACKGROUND OF THE INVENTION

The invention seeks to provide a more efficient and economical apparatus for coating a metal strip moving at high speed in a rolling mill or process line with oil or other lubricant. More particularly, the invention provides an improved ionic strip coating apparatus which operates at a much lower and safer voltage and amperage than known prior art systems, lessens the consumption of oil and more completely and uniformly coats the metal strip on both sides during its passage through a very compact coating apparatus which requires much less floor space than prior art systems. The apparatus is a unit which contains an electrical power supply, a circulating system for lubricant enabling excess lubricant to be recovered, and a pair of pinch rolls through which the lubricated strip may pass. The purpose of the pinch rolls is only to hold a fixed pass line of the strip with respect to the oil discharge headers.

In accordance with an important feature which distinguishes the invention from the prior art, pressurized air jets or sprays are directed at the attracted oil streams as they exit from a header and these streams are dispersed into a multitude of finer streams in a crossing pattern which assures complete and uniform coating of the moving strip across its full width.

Known prior art ionic systems operate at a voltage and current value far above that of the invention, and consequently are capable of causing a lethal shock. Prior art voltage and current are of the order of 150,000 volts at 1000 microamps. In contrast to this, the invention utilizes 60,000 to 100,000 V. at only about 10 microamps. As a consequence, the invention is entirely safe and cannot cause a lethal shock.

Additionally, from a construction standpoint, the apparatus employed is much simpler and more compact than the prior art.

Other features and advantages of the invention will become apparent during the course of the following description.

BRIEF DESCRIPTION OF THE DRAWINGS

FIG. 1 is a partly schematic perspective view of the invention.

FIG. 2 is a schematic cross section through the moving strip depicting the dispersing of lubricant streams caused by the pressurized air jets or sprays.

FIG. 3 is a cross sectional view taken through the coating apparatus.

FIG. 5 is a side elevational view of the apparatus.

FIG. 6 is a cross sectional view showing a modification of the invention.

DETAILED DESCRIPTION

Figure 4:
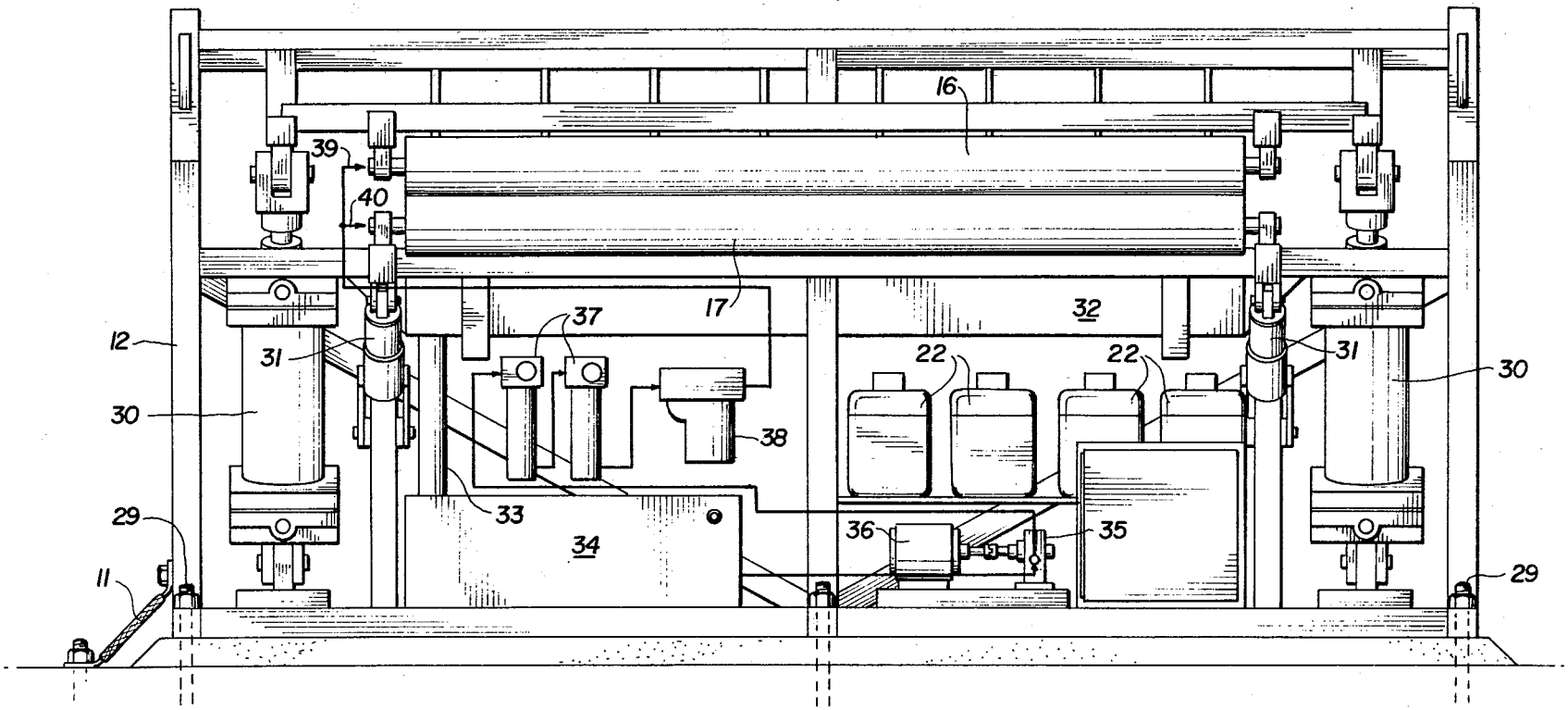
FIG. 4 is a front elevational view of the apparatus.

Referring to the drawings in detail wherein like numerals designate like parts, the numeral 10 designates a metal strip moving at a speed of as much as 6000 feet per minute through a coating apparatus constructed as shown in the drawings. The strip 10 is electrically grounded through a ground strap 11 connected to the frame 12 of the coating apparatus.

The heart of the ionic coating apparatus is depicted in FIGS. 1, 2 and 3 of the drawings and comprises upper and lower coating headers 13 and 14 formed of dielectric material and extending transversely across the width of the moving strip 10 above and below the same in spaced relationship thereto. The strip 10 passes between pairs of upstream and downstream dielectric guard bars 15 in closely spaced relationship to the strip and somewhat further downstream through top and bottom pinch rolls 16 and 17.

The upper header 13 is preferably square in cross section with its four corners located on vertical and horizontal orthogonal axes. An outlet slot 18 for oil or other liquid lubricant is provided at the downstream corner of the header and extends substantially for its entire length. A gutter member 19 of L-shaped cross section is preferably secured to the upper header 13 as shown in FIG. 3 with the lip of the gutter member spaced slightly below and downstream from the outlet slot 18.

The lower lubricant header 14 may be circular in cross section, or a different shape in some cases. It has an outlet slot 20 in its upper downstream quadrant extending for substantially its entire length and located substantially below the slot 18.

Each of the headers 13 and 14 is adapted to contain a pool of lubricant therein up to the approximate level of the slot 18 or 20. An electrode rod 21 at the bottom of each header 13 and 14 and completely submerged in the header lubricant bath receives a charge from an appropriate power supply 22 contained in the apparatus. Typically, this charge impressed on the electrodes 21 has a magnitude of 60,000–100,000 V. at 10 microamps, which is a very safe charge and will not cause a lethal shock to workers. This ionic charge on the lubricant baths in the two headers causes the liquid lubricant to be attracted to the grounded moving strip 10 in accordance with a known phenomenon. This attraction results in plural discrete streams 23 of lubricant being drawn from the two slots 18 and 20 and propelled toward the top and bottom of the strip 10 at converging angles, FIG. 3.

A very important aspect of the invention is the provision of two compressed air manifolds 24 and 25 at the top of header 13 and below and downstream from the header 14, respectively, FIG. 3. These two manifolds 24 and 25 are apertured or slotted along their lengths in parallel relationship to the slots 18 and 20. In the use of the system, the air manifold 24 delivers pressurized air sprays 26 downwardly in close relationship to the upper downstream inclined wall 27 of header 13 so as to impinge on the liquid lubricant streams 23 as they exit the slot 18 due to attraction to the grounded strip 10. This impingement of the air sprays on the liquid streams 23 disturbs and disperses the liquid streams into a multitude of very fine intersecting and crossing streams 28 across the top of the strip 10, FIG. 2, to completely and uniformly coat the top of the strip by utilization of a minimum amount of oil, or other lubricant. The combination of the attracted liquid streams 23 and the action of the air jets or sprays 26 thereon to disperse the streams eliminates entirely uncoated areas on the strips 10, excessive coating, and pooling of lubricant, thereby preventing waste of oil, overcoating or undercoating.

In the coating of the top side of strip 10, the multiple air sprays 26 are normally required. In some cases, the coating of the bottom of the strip may not require the air sprays 26' from the lower air manifold 25. When used, the air sprays 26' are directed tangentially across the outlet slot 20 to impinge on the upwardly directed streams 23 generally normal to their axes. This results in dispersing the liquid streams into a multiplicity of much finer intersecting and crossing streams 28' which completely and uniformly coat the bottom of the strip 10 in substantially the same manner that its top side is being simultaneously coated.

A favorable aspect of the process is that it is self-adjusting to the width of the strip 10. That is, if the strip 10 is narrower than the lengths of the headers 13 and 14 and their outlet slots 18 and 20, the oil will only be pulled out of the slots across the width of the strip and not beyond the two longitudinal edges of the strip. A wider strip 10 up to the full lengths of the slots 18 and 20 will attract the liquid lubricant across its entire width.

Therefore, the coating system automatically turns on and off merely by the presence or absence of the grounded strip 10 adjacent to the charged oil outlet slots 18 or 20. Prior to the leading end of a strip moving adjacent to these slots, there will be no attraction of the oil to the strip 10 and, in essence, the oiling system will be off or inactive without the necessity for employing a separate turn-off means. On the other hand, whenever a strip of any width within the range of widths which the system can accomodate is passing adjacent to the oil delivery slots 18 or 20, there will be attraction of oil onto one or both sides of the strip across the full width of the strip and therefore the mere presence of the strip turns on the oiling system automatically without the need for any separate turn-on means. As stated, the oil from slots 18 and 20 is attracted to the strip only in the area defined by the width of the particular strip, whether narrow or wide, in the range of widths which the apparatus can handle. This conserves oil and keeps the environment clean.

Compressed air for the headers 24 and 25 is supplied from any convenient remote source, not shown. The air pressure intensity required is less than 10 PSIG, thereby avoiding any contamination of a local area with lubricant fumes or mist.

The apparatus in FIGS. 4 and 5 is a unit which occupies comparatively little floor space and is anchored to the floor at 29. The coating components and the pinch rolls 16 and 17 span the grounded strip 10 transversely at right angles to its path of movement. Power cylinders 30 are provided on the apparatus to raise and lower the top pinch roll 16 relative to the lower roll 17 which is spring-loaded by devices 31. The apparatus further contains a drain basin 32 for the excess coating lubricant which returns the collected lubricant through a pipe 33 to a reservoir 34. From this reservoir, a pump 35 operated by a motor 36 circulates the oil through heaters 37 which maintain it at a temperature of approximately 180° F. This temperature may vary depending on viscosity of the coating fluid. From these heaters, the oil passes through a filter 38 and from the filter passes through lines 39 and 40 leading into the two headers 13 and 14 where the oil is pooled.

FIG. 6 depicts a modification of the invention wherein the grounded strip 10 is shown above a circular liquid lubricant header 41 having an upper outlet slot 42 and containing a pool 43 of oil or the like within which a charged electrode 44 is submerged. Surrounding the header 41 eccentrically in downwardly offset relationship is an air manifold 45 and set screw means 46 to adjust the air manifold relative to the liquid header. The manifold 45 has an upper outlet slot 47 for an air spray including convergent walls 48. Air under pressure is supplied to the chamber 49 between the header 41 and manifold 45, the chamber diminishing in radial width toward its top.

In operation, the liquid lubricant which is ionically charged is attracted through the slot 42 toward the moving strip 10. Simultaneously, an air spray is emitted through the slot 47 and disperses the liquid in a fine spray which spans approximately 120° included angle to coat the bottom of the strip 10 completely and uniformly. Without the introduction of the air spray, the coating is not complete and uniform because the liquid emitting from the header 41 is in the form of spaced streams which impinge on the strip in an uneven and unequal manner. The inclusion of the air not only disperses these streams but creates a nearly homogeneous depositing of the liquid lubricant on the metal strip.

While FIG. 6 depicts a coating arrangement for the bottom of the strip 10, it should be understood that a like coating unit can be mounted above the strip for the simultaneous coating of its top. The other described advantages of the prior embodiment of the invention are also obtained with the embodiment shown in FIG. 6.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. An apparatus for coating a high speed moving strip with a liquid comprising liquid header delivery means for positioning on at least one side of the strip in spaced relation thereto so as to deliver multiple streams of liquid onto the strip, and simultaneously operable pressurized air spray delivery means directing an air spray onto said streams and dispersing the streams into a multitude of much finer liquid streams in a crossing pattern to completely and uniformly coat said strip, the air spray delivery means substantially surrounding the liquid header and having an outlet substantially in registration with the outlet of the header, and the liquid header and air spray delivery means comprising eccentrically interfitting cylindrical bodies, and means to adjust the eccentric relationship of the bodies one with respect to the other.

2. An apparatus for coating a high speed moving strip which is electrically grounded with oil or the like which is electrically charged whereby the oil will be attracted to the moving strip comprising an oil delivery header for positioning on at least one side of the strip across the strip in spaced relation thereto and having an oil outlet slot, a charging electrode within the header for submerging in a pool of oil contained in the header with the surface of said pool substantially at the level of said slot, and a simultaneously operable parallel axis pressurized air delivery header spaced exteriorly from the oil delivery header on one side of the outlet slot of the oil delivery header for directing pressurized air sprays onto discrete coating streams of oil leaving said slot and being directed onto said strip by electrostatic attraction, and the air sprays positioned so as to impinge on the discrete oil streams in the region between said outlet slot and strip to disperse the discrete oil streams into a multitude of substantially finer streams in a crossing pattern so that the strip will be coated with oil uniformly across its width.

3. An apparatus for coating a high speed moving strip as defined in claim 2, including opposed oil delivery and air delivery headers for coating the strip with oil uniformly across its width on opposite sides during passage through the apparatus.

4. An apparatus for coating a high speed moving strip as defined in claim 2, and said outlet slot of the oil delivery header being disposed to deliver said discrete streams in a downstream direction with relation to the path of movement of the strip and at an angle converging with the plane occupied by the strip, and the pressurized air sprays from the air delivery header being directed substantially across the longitudinal axis of said oil outlet slot to propel the discrete streams of oil toward the strip while dispersing the oil streams into said multitude of crossing fine streams.

5. An apparatus for coating a high speed moving strip as defined in claim 2, and said electrode within the header extending longitudinally of the header across the full width of any strip within the width range of strips which the apparatus can accommodate, whereby the dispersed fine streams of oil are electrostatically attracted to the strip of any width in said range of widths and are not attracted in regions along the length of the oil delivery slot not spanned by the strip, whereby the apparatus possesses automatic coating width adjustment and the ability to automatically turn on and off merely by the presence or absence of the strip.

* * * * *